United States Patent [19]

Armelin

[11] Patent Number: 4,462,311

[45] Date of Patent: Jul. 31, 1984

[54] OFFSET PRINTING MACHINE WITH VARIABLE FORMAT

[75] Inventor: Georges E. Armelin, Orleans, France

[73] Assignee: Machines Chambon, Orleans, France

[21] Appl. No.: 497,520

[22] Filed: May 24, 1983

[30] Foreign Application Priority Data

May 25, 1982 [FR] France ..... 82 09006

[51] Int. Cl.[3] ..... B41F 7/04; B41F 13/20

[52] U.S. Cl. ..... 101/143; 101/247; 101/218

[58] Field of Search ..... 101/217, 218, 177, 137, 101/142, 143, 144, 152, 153, 154, 219–228, 247, 139, 140, 145, 216

[56] References Cited

U.S. PATENT DOCUMENTS

| | | | |
|---|---|---|---|
| 3,323,452 | 6/1967 | Pasquinelli | 101/218 |
| 3,611,924 | 10/1971 | Harrison | 101/218 |
| 3,613,577 | 10/1971 | Halley | 101/152 |
| 4,046,070 | 9/1977 | Halley | 101/216 |

FOREIGN PATENT DOCUMENTS

| | | | |
|---|---|---|---|
| 2949872 | 7/1980 | Fed. Rep. of Germany | 101/217 |
| 1445071 | 5/1966 | France . | |
| 2350198 | 12/1977 | France . | |
| 2443930 | 7/1980 | France . | |
| 2046664 | 11/1980 | United Kingdom . | |

*Primary Examiner*—J. Reed Fisher

*Attorney, Agent, or Firm*—McAulay, Fields, Fisher, Goldstein & Nissen

[57] ABSTRACT

An offset printing machine with variable format comprises two upper transverse rails extending between two front and rear longitudianl uprights of the frame of the machine. A cassette carrying the plate and blanket cylinders is suspended from these rails, during a movement of introduction or removal of said cassette, via upper rollers of horizontal and longitudinal axes mounted in the upper part of the cassette. These two upper transverse rails project forwardly with respect to the front upright of the frame. This front upright bears, on its outer face, two lower horizontal arms extending forwardly and on which the cassette rolls, during a movement of introduction or removal, via lower rollers of horizontal and longitudinal axes, mounted in the lower part of the cassette.

9 Claims, 7 Drawing Figures

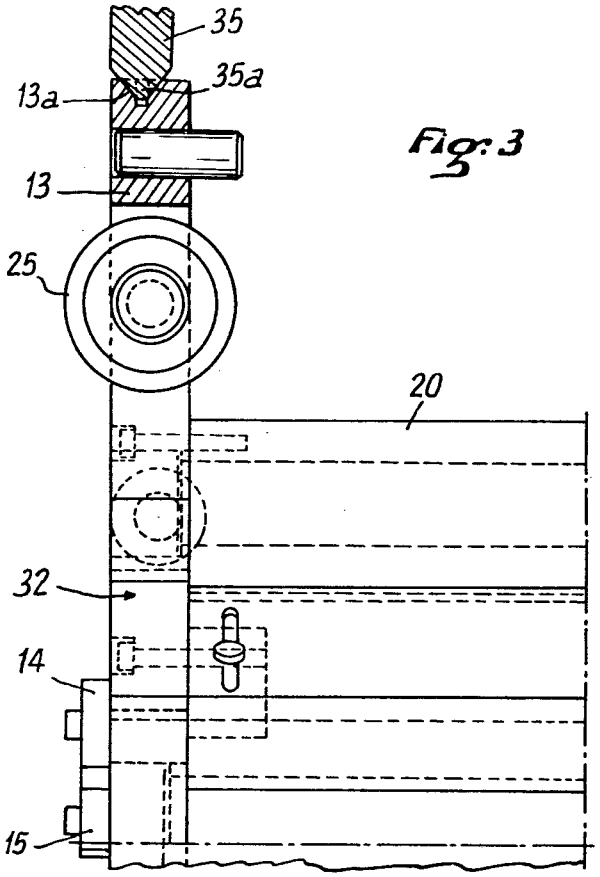
Fig: 3
Fig: 4
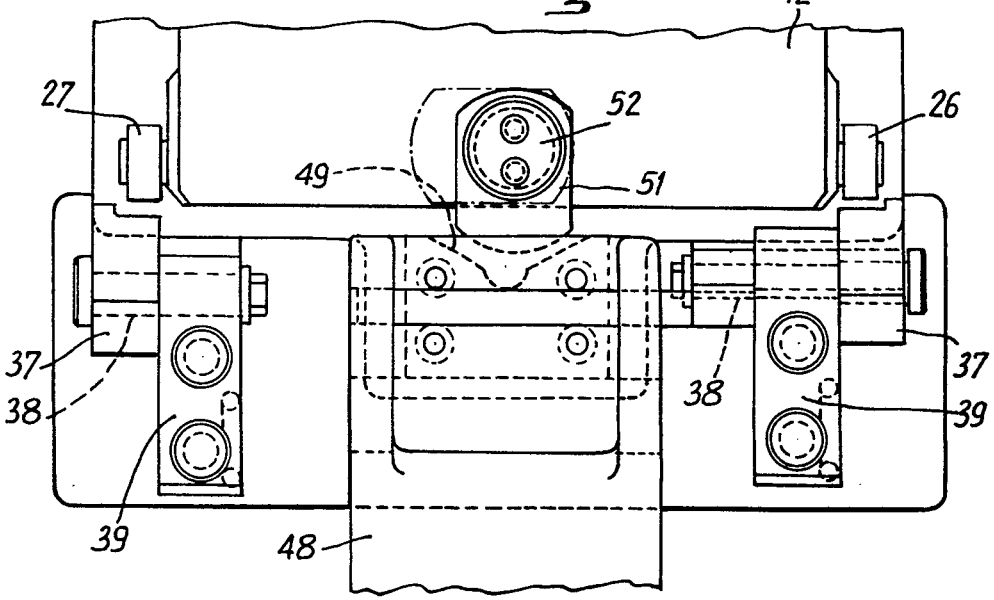

OFFSET PRINTING MACHINE WITH VARIABLE FORMAT

BACKGROUND OF THE INVENTION

The present invention relates an offset printing machine with variable format.

It is known that offset printing machines comprise an inking device and a dampening device for applying a layer of ink and a layer of a dampening solution, generally water, on the surface of at least one inking roller itself in contact with a plate cylinder. A blanket cylinder is mounted tangentially to the plate cylinder to effect printing on a web or sheet advancing between this blanket cylinder and an impression cylinder applied under pressure thereagainst.

Such a known machine, provided for successively printing several colours on the same web, comprises a plurality of superposed printing assemblies, each of these printing assemblies comprising a plate cylinder and a blanket cylinder mounted tangentially to each other in the same horizontal plane. The pairs of plate and blanket cylinders are thus superposed and are all borne by a unit adapted to be displaced in the transverse direction, i.e. perpendicularly to the direction of advance of the printed web, so as to be removable from the frame of the machine and replaced by another similar unit bearing plates corresponding to a fresh printing operation. Such a machine, although is presents incontestable advantages as far as the convenience of replacing the plate cylinders is concerned, is, however, not adapted to printing in different formats which requires relatively frequent replacements of the plate cylinders, as a function of the desired format of print.

SUMMARY OF THE INVENTION

It is an object of the present invention to overcome these drawbacks by providing a printing machine comprising very simple means for easily and rapidly changing the plate cylinder and the blanket cylinder in the case of a change of format, for easily cleaning the offset plate, and easily changing this plate or even the blancket if the latter is worn out.

To this end, this offset printing machine with variable format comprising at least one inking roller receiving a layer of ink from an inking device and a layer of dampening solution from a dampening device, a plate cylinder tangential to the inking roller, a blanket cylinder tangential to the plate cylinder and an impression cylinder mounted on a mobile support so as to be applied under pressure against the blanket cylinder, the web to be printed passing between this blanket and the impression cylinder, the plate cylinder and the blanket cylinder being mounted to rotate between two vertical and longitudinal side elements connected together by cross pieces and forming therewith a cassette which is mobile transversely, i.e. perpendicularly to the direction of advance of the printed web, is characterized in that it comprises two upper transverse rails extending between two front and rear longitudinal uprights of the frame of the machine and from which the cassette is suspended, during a movement of introduction or removal of said cassette, via upper rollers of horizontal and longitudinal axes mounted in the upper part of the cassette, these two upper transverse rails projecting forwardly with respect to the front upright of the frame, and in that this front upright bears, on its outer face, two lower horizontal arms extending forwardly and on which the cassette rolls, during a movement of introduction or removal, via lower rollers of horizontal and longitudinal axes, mounted in the lower part of the cassette.

According to a further feature of the invention, the two lower horizontal arms borne by the front upright of the frame are preferably mounted to pivot on this upright so as to be retracted along the front upright, in a substantially vertical position, when they are not used for the introduction or removal of a cassette.

According to another feature of the invention, the printing machine comprises in its lower part, beneath the impression cylinder, a transversely mobile support adapted to be pulled forwardly so as to be in overhang with respect to the front upright of the machine, and means fast with the front end of the mobile support to support the front vertical and longitudinal side element of the cassette, when the latter is pulled completely out of the machine.

The printing machine according to the invention allows a cassette provided with a plate cylinder and a blanket cylinder to be very easily removed with a view to changing format. Once this cassette has been pulled out of the machine, it may either be taken over and manipulated by a suitable hoisting apparatus or may be placed on a mobile carriage bearing another cassette having to replace the one previously used. The cassette may thus remain on the support, once removed, to allow a rapid change of the printing and/or blanket cylinder or for cleaning the plate. The machine also comprises means for automatically wedging the plate cylinder of a cassette under pressure, when the latter has been introduced inside the machine.

According to another feature of the invention, the beginning of the movement in the cassette is effected by means of a drive pinion mounted on the rear upright of the frame and which is in mesh with a pinion fast with the shaft of the blanket cylinder, which is permanently coupled with a pinion fast with the shaft of the plate cylinder. Due to such an arrangement, as the plate cylinder always creates a braking action with respect to the blanket cylinder, compensation is obtained of the clearance in the transmision gears which is always located on the same side and consequently a better precision of print is obtained. If drive were produced from the plate cylinder, tensions might occur in the web upstream and downstream, due to the lack of balance, whether the blanket cylinder is operating, depending on the case, as a motor or brake, which, at the point of coupling between the plate cylinder and the blanket cylinder, would cause a slide relative to the clearance between the teeth of the gears in mesh, hence imprecise printing. The fact that the movement is produced, in the apparatus according to the invention, from the blanket cylinder, makes it possible completely to avoid such imprecision. Furthermore, this also allows a constant web speed, for a constant speed of rotation of the drive motor, whateve the format. In other words, the installed power of motor is constant for the various formats of the print.

According to a further feature of the invention, the wedging under pressure of the plate cylinder of the cassette against the inking roller or rollers is effected by pivoting the cassette about one of the upper transverse rails forming pivot axis, under the action of jacks borne by the two uprights of the frame and exerting their efforts on the vertical edges of the two longitudinal side elements of the cassette which are adjacent the other upper transverse rail. The pivoting movement of the cassette is limited by adjustable stops on which abut the upper edges of the vertical and longitudinal side elements of the cassette, these stops defining the touch between the plate cylinder and the or each inking roller, in other words the crushing of the latter. In any case, during a change of cassette corresponding to a change of format, a correct wedging under pressure of the new plate cylinder is automatically obtained, if the adjustable stops have not been developed.

BRIEF DESCRIPTION OF THE DRAWINGS

The invention will be more readily understood on reading the following description with reference to the accompanying drawings, in which:

FIG. 3 is a view in vertical and transverse section made along line III—III of FIG. 2;

FIG. 4 is a view in elevation of the front lower part of a cassette and associated members mounted on the frame;

DESCRIPTION OF THE PREFERRED EMBODIMENTS

Figure 1:
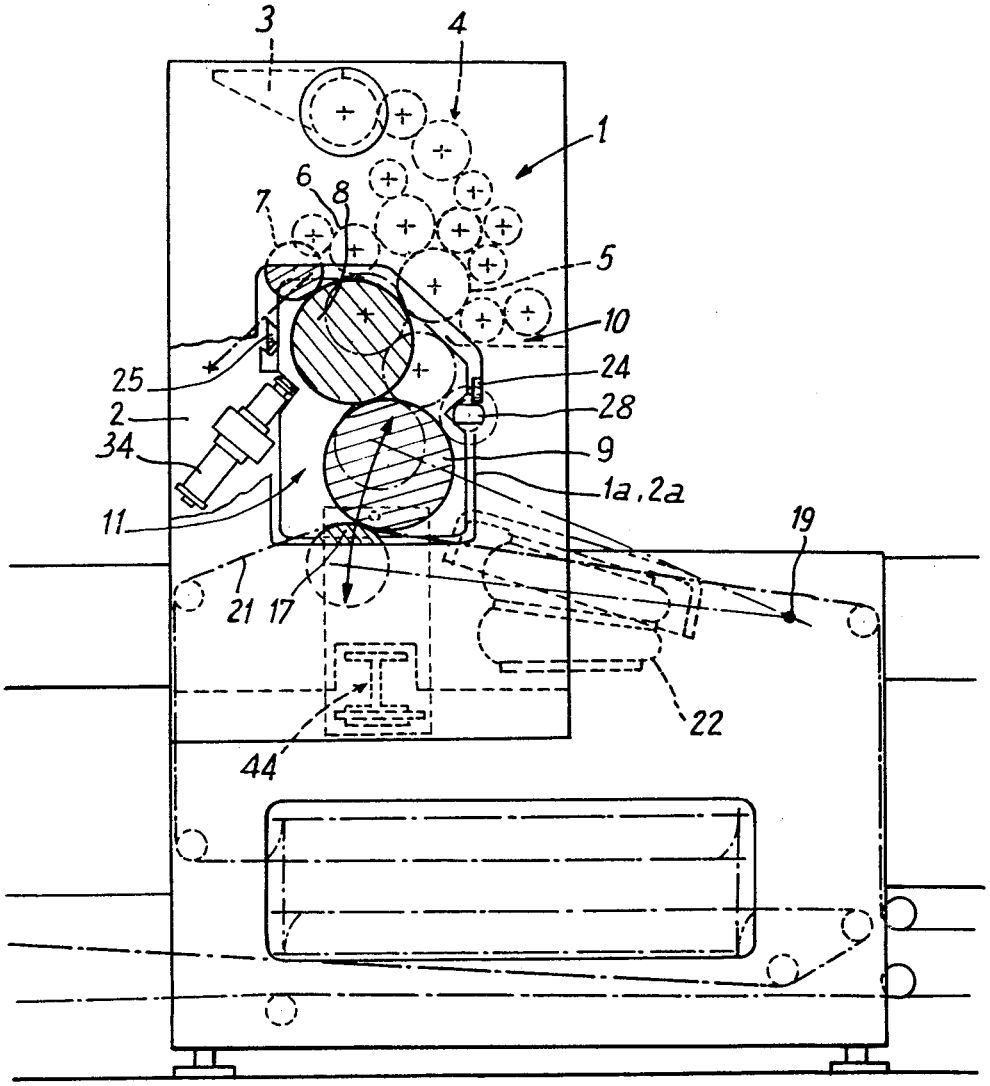
FIG. 1 is a view in elevation, with parts torn away, of an offset printing machine according to the invention.

Referring now to the drawings, the offset printing machine shown in FIG. 1 comprises a frame essentially constituted by two front and rear longitudinal uprights 1 and 2 respectively, between which the different cylinders of the printing machine extend horizontally. In the present description, the terms "longitudinal" and "transverse" respectively means "parallel" and "perpendicular" to the direction of advance of the printed web. In the upper part, the frame 1, 2 bears an ink fountain 3 which distributes ink via a certain number of evener and sliding rollers generally designated by reference 4. These rollers conduct the ink to three inking rollers 5, 6, 7. A dampening device 10 is also provided to supply a dampening solution, generally water, to the plate via the inking rollers. With the three inking rollers is in contact a plate cylinder 8 itself tangential to a blanket cylinder 9. The two inking rollers 5 and 6 are mounted in fixed positions on the frame whilst the third inking roller 7 is mounted to move on the frame so that, whatever the the format, these three inking rollers are all tangential to the plate cylinder 8. The two plate and blanket cylinders 8 and 9 are mounted to rotate on a cassette 11 which forms an independant assembly and which is mobile with respect to the frame 1, 2 of the machine, in the transverse direction. This cassette 11 essentially comprises two vertical and longitudinal side elements, namely a front side element 12 and a rear side element 13 braced by cross pieces 20 (FIG. 3) and between which extend the plate cylinder 8 and the blanket cylinder 9. The position of the crosspieces 20 on the different cassettes depends on the format of the print. The cylinders 8 and 9 are borne by shafts mounted to rotate in bearings borne by the two transverse side elements 12, 13 and respectively fast, at their rear ends, with pinions 14 and 15 located outside the rear end element 13.

Figure 2:
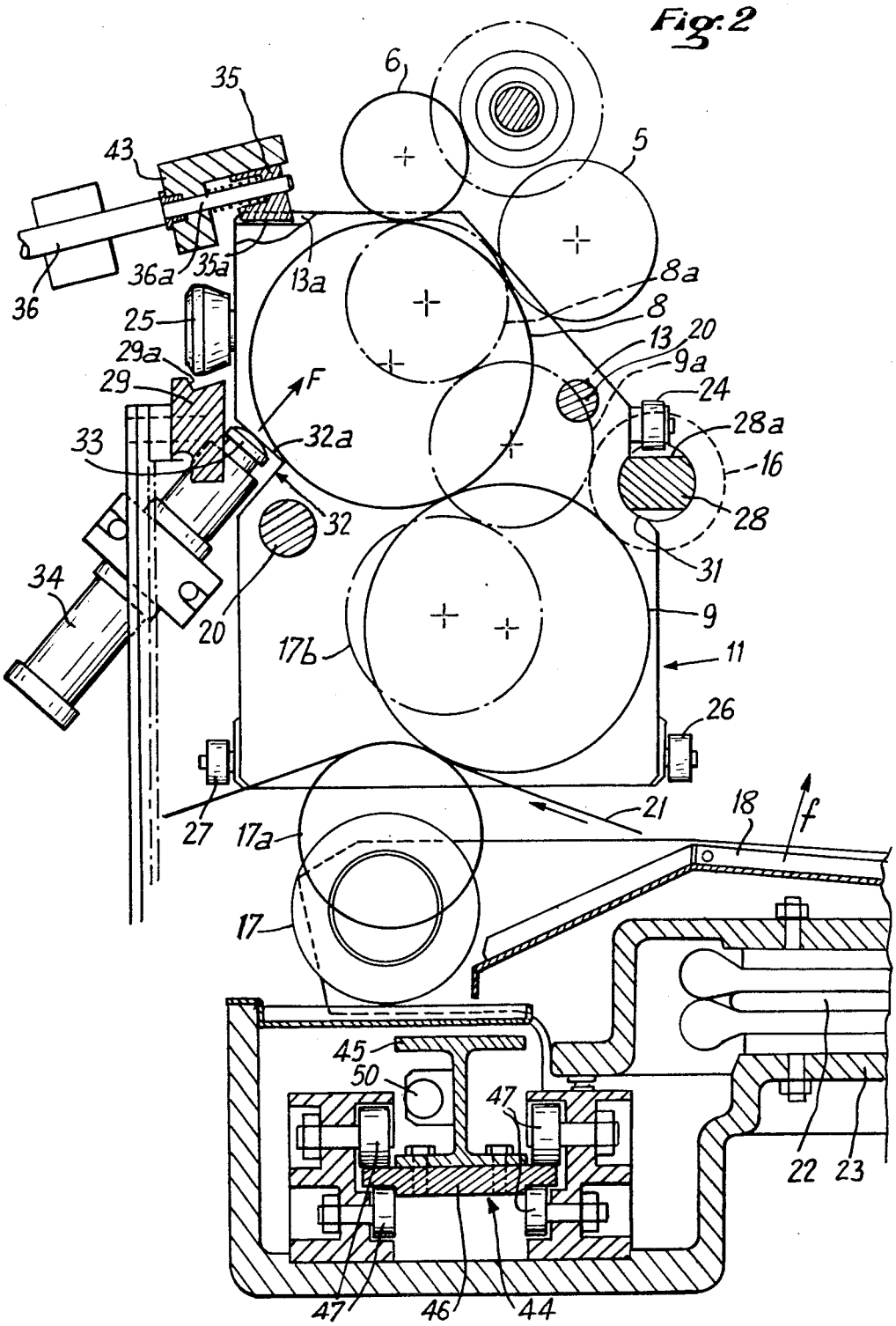
FIG. 2 is a simplified view in vertical and longitudinal section, on a larger scale, of the offset printing machine.

Each cassette 11 bears a pair of plate and blanket cylinders 8 and 9 corresponding to a determined format. As will be seen hereinafter, the machine according to the invention enables one cassette 11 to be replaced very easily by another when the print format is to be changed. FIGS. 1 and 2 show in solid lines two plate and blanket cylinders 8 and 9 corresponding to a large format, and in chain-dotted lines two other plate and blanket cylinders **8*a* and 9*a* corresponding to small format. An infinity of other cassettes 11 may, of course, be provided, bearing cylinders having diameters included between those of the large format cylinders 8, 9 and small format cylinders 8*a*, 9*a*. The drive pinions 14, 15 have a primitive diameter corresponding substantially to that of the cylinders 8, 9, so that, in FIGS. 1 and 2**, they virtually merge with the circles representing the peripheral surfaces of these cylinders.

Each cassette 11 bears, on the front face of the plate cylinder 8, a graduated disc allowing an angular presetting of the cylinders with respect to one another, and this whatever the position in which the machine stops.

The plate and blanket cylinders 8 and 9 are driven in rotation from a pinion 16 which is mounted to rotate on the rear upright 2 of the frame and which is driven in rotation, via an appropriate transmission mechanism (not shown), by a general control motor. This drive pinion 16 is always in mesh, whatever the print format, with the pinion 15 fast with the shaft of the blanket cylinder 9, which pinion 15 is in turn in mesh with the pinion 14 fast with the shaft of the plate cylinder 8. The pinion 16 is always the same and the pinions 14 and 15 are cut in corrected helicoids so that the pinion 16 always meshes correctly.

In its lower part, the printing machine comprises an impression cylinder 17 which is mounted idly and whose shaft extends between two side elements constituting a mobile support 18 for the impression cylinder 17. This support 18 is mounted to pivot about a transverse spindle 19 (FIG. 1) so that the support 18 and the impression cylinder 17 may occupy several positions as a function of the print format. In FIG. 1, the impression cylinder is shown in its lowermost Position, in which it is retracted to allow the cassette 11 to be removed or positioned as will be seen hereinafter. In this lowermost position, it is spaced apart from the blanket cylinder 9, beneath the lower edges of the vertical and longitudinal side elements 12 and 13 of the cassette 11. In FIG. 2, the impression cylinder is shown in a slightly higher position **17*a* in which it is tangential to the blanket cylinder 9 corresponding to large format, and in a still higher position 17*b* in which it is tangential to the blanket cylinder 9*a*** corresponding to small format.

The web of paper 21 which is to be printed on passes, in conventional manner, between the lower impression cylinder 17 and the blanket cylinder 9, these two cylinders being tangential and pressed against each other during printing.

The position of the lower impression cylinder 17 about its pivot axis 19 is adjusted by means of a pneumatic or hydraulic jack 22, for example of the bellows type, disposed beneath the pivoting support 18 and abutting on a base 23 forming part of the frame of the machine. When the jack 22 is supplied with pressurized fluid, it expands and then provokes a pivoting movement of the support 18 and the impression cylinder 17 in clockwise direction about spindle 19, as indicated by arrow f in FIG. 2. The impression cylinder 17 is provided with roller tracks mounted on eccentrics and rolling on other roller tracks on the blanket cylinder 9 in order to adjust the spacing between the two cylinders 9 and 17 depending on the material of the printed web and the work to be carried out.

Each cassette 11 bearing a pair of plate and blanket cylinders 8 and 9 may be displaced horizontally and transversely when the format is to be changed. To this end, the two front and rear uprights 1 and 2 of the frame are respectively pierced with openings 1*a*, 2*a* whose shape corresponds to that of the vertical side elements 12, 13 of the cassette 11, with, however, slightly larger dimensions. Each of the vertical side elements 12, 13 bears, in its upper part, two rollers 24, 25 and, in its lower part, two other rollers 26, 27, all these rollers being mounted to rotate on horizontal and longitudinal pivots borne by the two opposite vertical edges of each of the side elements 12, 13. The upper righthand roller 24, with reference to FIG. 2, is located above an upper transverse rail 28 which extends between the two uprights 1, 2 of the frame and which projects forwardly with respect to the front upright 1. This rail 28 is constituted by a portion of cylindrical bar presenting a horizontal upper flat portion 28*a* on which the rollers 24 may roll. Furthermore, the upper rollers 25 are disposed above another support rail 29 extending transversely between the two uprights 1, 2 and projecting forwardly, with respect to the front upright 1. Each roller 25 is biconical in form and it is adapted to engage and roll in a groove 29*a* of triangular cross section adapted to the shape of the roller 25 and made in the upper face of the support guide rail 29.

Each of the vertical side elements 12, 13 of the cassette 11 presents, in its right-hand vertical edge, a notch 31 in the form of an arc of circle whose radius corresponds to that of the cylindrical part of the right-hand support rail 28. This notch 31 is made at such a height, with respect to the lower edge of the side element 12, 13, that, when the cassette 11 is introduced into the machine, this notch 31 is substantially at the level of the right-hand support rail 28.

Furthermore, each of the side elements 12, 13 presents, in its left-hand vertical edge, a V-notch 32 whose point extends horizontally towards the inside of the side element and whose upper side 32*a*, inclined with respect to the horizontal, constitutes a bearing surface for the end of the rod 33 of a jack 34. Each jack 34 is mounted on the associated upright 1, 2 of the frame, so as to be inclined and so that its axis is perpendicular to the bearing surface 32*a* of the corresponding side element 12, 13.

Each of the side elements 12, 13 present, in its horizontal upper edge, a horizontal groove such as groove 13*a* of V-section and in which engages the lower part, likewise of V-section, of an adjustable stop 35. The position of this stop is adjusted by means of a rod mounted to rotate in a support 43 and whose threaded end part 36*a* is screwed in a tapped hole made in the stop 35. The axis of the adjusting rod 36 is slightly inclined with respect to the horizontal and the lower edge 35*a* of the stop 35 is in turn inclined by the same angle with respect to the axis of the rod 36 so that this edge 35*a* extends horizontally. Consequently, a rotation of the rod 36, in one direction or the other, makes it possible to displace the stop 35 longitudinally and consequently to place the lower edge 35*a* thereof more or less far in the groove 13*a* in the side element 13, therefore to adjust the position of the cassette 11 and thus the touch with the two right-hand and central inking rollers 5 and 6. According to a variant embodiment, only one of the side elements 12, 13 might present a V-sectioned groove in its upper edge, ensuring a function of centering in cooperation with a stop of the same shape, the other side element then presenting a flat upper edge cooperating with an adjustable flat stop.

Figure 5:
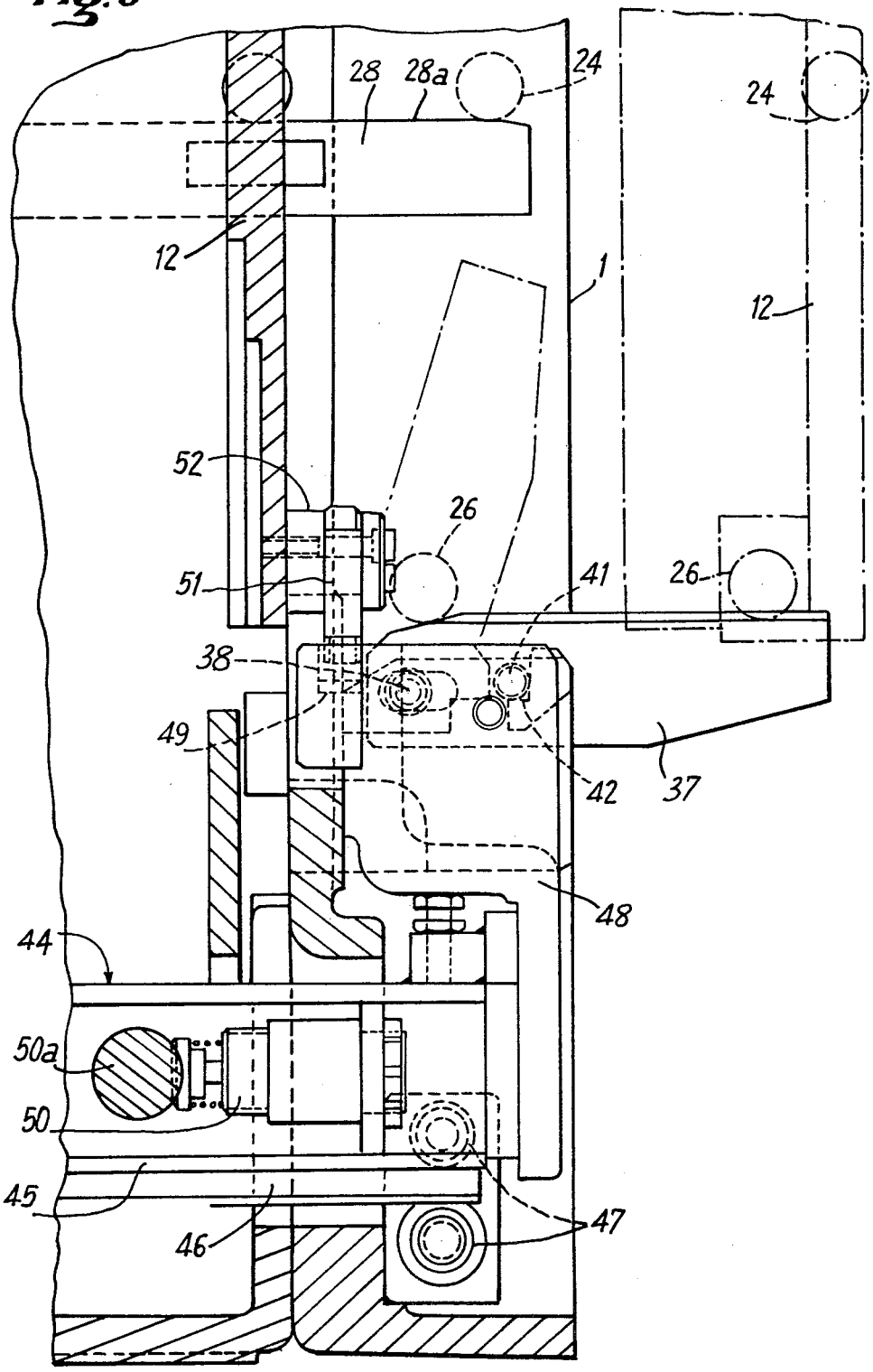
FIG. 5 is a view in vertical, transverse section of the lower part of the front upright of the frame and of the front side element of the cassette.

To allow partial removal of the cassette 11 towards the front, the printing machine according to the invention comprises, on the front upright 1, two pivoting arms 37 (FIGS. 4 and 5) which are articulated about longitudinal pins 38 borne by support bearings 39 fixed on the front upright 1. Each arm 37 may pivot between a retracted position inside the upright 1, as indicated in chain-dotted lines, and a horizontal position in which the arm 37 extends towards the outside, perpendicularly to the upright 1. The movement of pivoting of each arm 37 towards the horizontal position is limited by a finger 41 borne by this arm 37 and engaging in a notch 42 forming a stop.

The printing machine according to the invention is also provided, in its lower part, with a mobile support 44 which extends in the median vertical and transverse plane of the cassette 11. This mobile support 44 is constituted by an upper I-section 45 whose lower flange is fast with a horizontal platen 46 (FIG. 2) whose edges pass between rollers 47 disposed respectively above and below the platen 46, to ensure horizontal guiding of the support 44. At the front end of the horizontal mobile support 44 is fixed a vertical bracket 48 which presents a notch 49 in its upper face. In this notch may engage the end part of a connecting arm 51 which is articulated about a horizontal pivot 52 of transverse axis mounted in the media lower part of the front vertical side element 12 of the cassette 11.

The operation of the printing machine according to the invention and of the device for easily replacing one cassette 11 by another when the format is changed, will now be described.

It will be assumed that the machine is being used for printing with large format plate and blanket cylinders 8 and 9 and that these cylinders are to be replaced, with a view to printing a smaller format, by plate and blanket cylinders 8*a* and 9*a* of smaller diameter. In position for large format printing, the impression cylinder 17 occupies the position 17*a* of FIG. 2. Furthermore, the jacks 34 are supplied in such a way that each of them exerts, via its rod 33, a force F directed upwardly and inclined with respect to the vertical. This force F applies each of the vertical side elements 12, 13 against the right hand support rail 28 and the adjustable wedge-shaped stops 35. In this position, the plate cylinder 8*a* is applied against the inking rollers 5, 6, 7 which are themselves mounted on the frame. The adjustable stops 35 make it possible to adjust the touch of the Plate cylinder 8 with the right-hand and central inking rollers 5 and 6, in other words the greater or lesser crushing of the supple surface layer of these inking rollers. Due to the effort F, the upper rollers 24 and 25 are raised with respect to the respective upper support guide rails 28 and 29.

Figure 6:
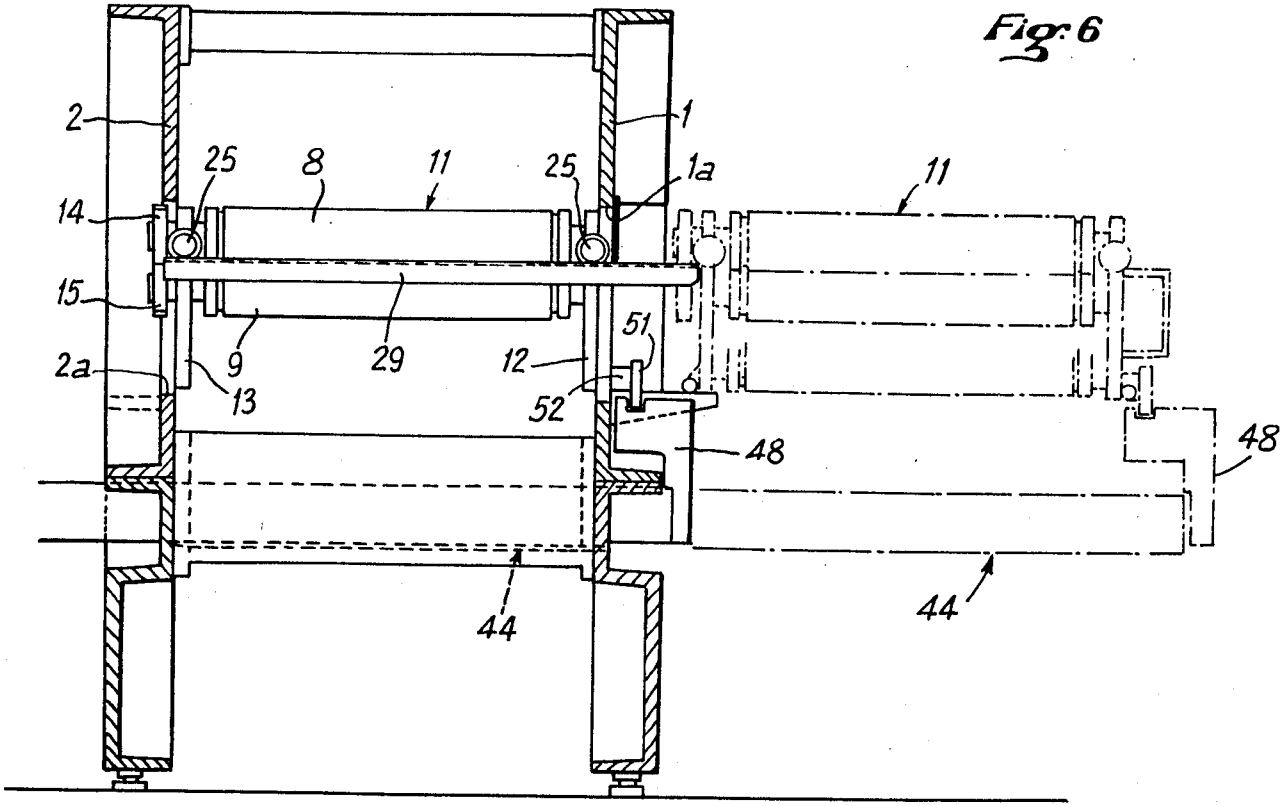
FIG. 6 is a simplified view in vertical, transverse section of the machine illustrating in chain-dotted lines a cassette in removed position, this cassette being adapted to be displaced by means of a hoisting member.

It will firstly be assumed that the cassette is changed by using a hoisting apparatus, such as a block and pulley borne by a carriage movable over an upper roller track. In this case, the cassette 11 is removed in the manner schematically illustrated in FIG. 6.

Before proceeding with removing the cassette 11 bearing the plate and blanket cylinders 8 and 9, the supply of the jack 22 is cut off so that the lower impression cylinder comes into its extreme lowermost position, beneath the lower edges of the side elements 12, 13. The supply of jacks 34 is then cut off. Consequently, the cassette 11 drops, under the effect of its own weight, onto the two support guide rails 28, 29. The cassette firstly pivots about the cylindrical part of the right-hand support rail 28 until the roller 25 comes into contact with the groove 29*a*. Then there is a slight slide towards the left until the roller 25 reaches the bottom of the groove and the righthand roller 24 comes into abutment on the upper flat portion 28*a* of the right-hand upper rail 28. The two front support arms 37 are then pivoted from their retracted vertical position into horizontal position as shown in solid lines in FIG. 5. The connecting arm 51 is always in its vertical position shown in FIG. 4, in which its lower end is engaged in the notch 49. From that moment, the front side element 12 and consequently the whole of the cassette 11 are connected in translation to the bracket 48 and to the lower mobile support 44. The cassette 11 is then pulled forwardly to remove it from the frame of the machine. This movement causes the lower mobile support 44 to be removed which occupies, in fully extended state, the position indicated in chain-dotted lines in FIG. 6. At the beginning of the movement, the four upper rollers 24, 25 are borne by the two support guide rails 28, 29 then, a little afterwards, only the rollers 24, 25 borne by the rear side element 13 remain in abutment on these rails, since the corresponding rollers 24, 25 borne by the first side element 12 have left the rails. From that moment, the weight of the cassette is partly taken up by the front end of the lower mobile support 44 in overhang. When the cassette 11 has come completely out of the printing machine, as indicated in chain-dotted lines in FIG. 6, the lower rollers 26, 27 borne by the rear side element 13 have come into abutment on the horizontal arms 37 and they thus support the cassette 11 in its rear part. The front part of the cassette is still supported by the bracket 48 fast with the front end of the mobile support 44. The cassette 11 then being completely removed from the printing machine, it is easy to raise it by means of a hoisting member such as a block and pulley and to replace it by another cassette 11 bearing the plate and blanket cylinders 8*a* and 9*a* corresponding to the small format.

The operation for introducing the new cassette 11 in the printing machine is carried out in reverse. The mobile assembly is pushed towards the inside of the machine until the lower mobile support 44 and the cassette 11 are completely retracted inside. A damping jack 50 which is borne by the mobile support 44, then comes into contact with a stop 50*a* borne by the base of the machine to avoid any sudden shock when the cassette 11 is introduced. Jacks 34 are then supplied so as to apply the new plate cylinder 8*a* against the inking rollers 6, 7. The side elements 12, 13 are firstly displaced in the direction of the upper rail 28 until the notch 31 of each of these side elements comes into contact with the cylindrical surface of the rail. The continuation of the effort F then brings about a pivoting movement of the whole of the cassette 11 about the axis of the right-hand upper rail 28, which has for its effect to apply the new plate cylinder 8*a* under pressure against the two right-hand and central inking rollers 5 and 6. The third inking roller 7, located to the left of the precedings ones, is then wedged, under the control of a jack (not shown), on a preadjusted stop of the cassette 11 which has just been introduced. The adjustable wedges 35 which have remained in position, make it possible to find the same touch as before.

Figure 7:
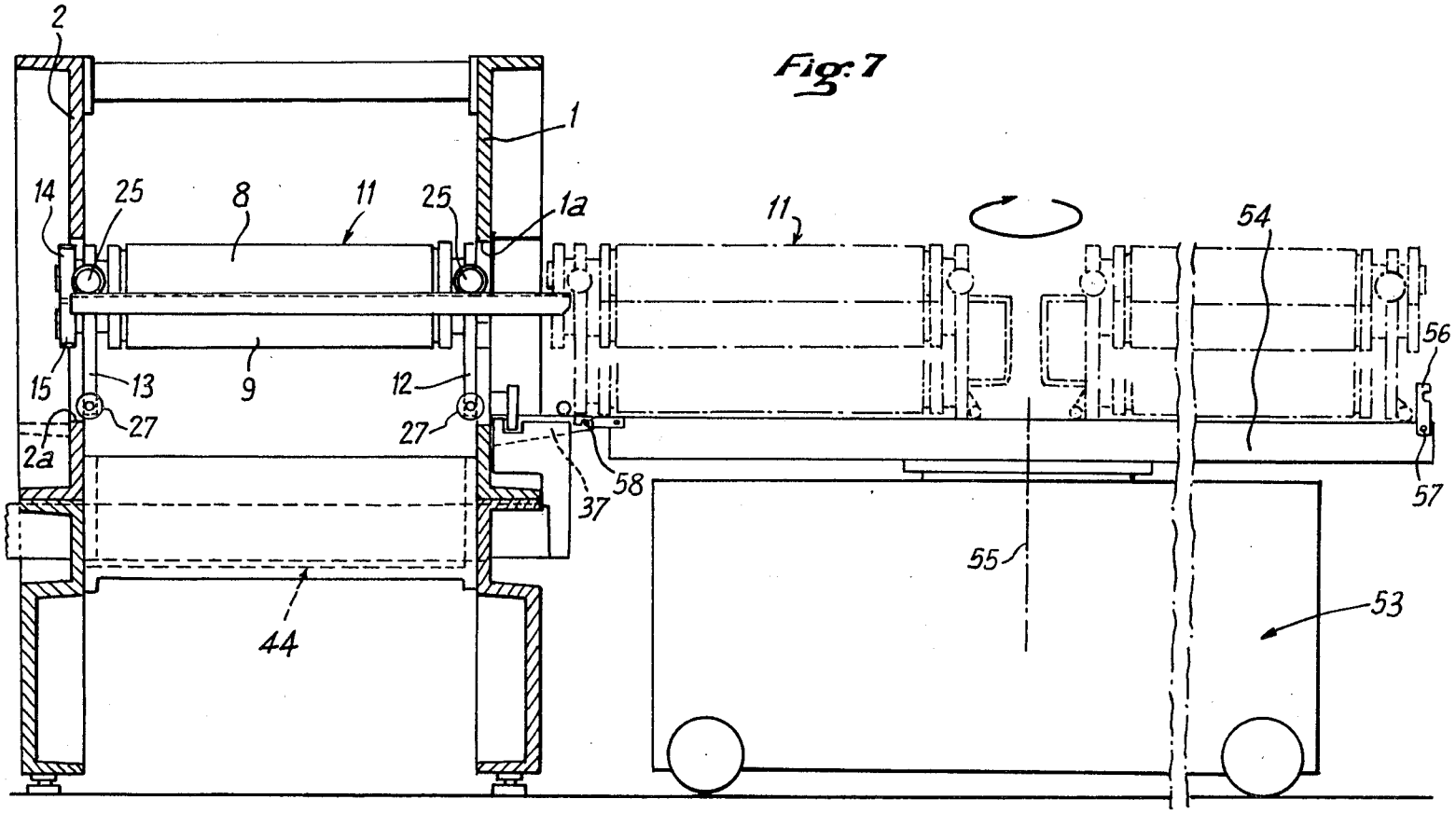
FIG. 7 is a view in vertical, transverse section of the machine illustrating in chain-dotted lines two cassettes mounted diametrically opposite each other on a carriage.

FIG. 7 illustrates the manner in which a change of cassette is effected by means of a mobile carriage 53. This carriage bears, in its upper part, a horizontal plate 54 pivoting about a vertical axis 55 and on which the cassette 11 may be radially disposed, these cassettes being shown in chain-dotted lines. In this case, the lower mobile support 44 is not used. To this end, the connecting arm 51 is pivoted from its vertical position to its horizontal position. On the other hand, a horizontal connection is established between the pivoting arms 37, extending horizontally towards the outside, and the rotary plate 54, by means of hooks 56 articulated on the edge of the plate 54, about axes 57 and adapted to hook on catches 58 provided on the arms 37. In this case, when a cassette 11 is removed from the printing machine, the lower front rollers 26, 27, after having rolled on the horizontal arms 37, abut on the upper face of the rotating plate 54 until the lower rear rollers 26, 27 in turn roll on the plate 54, after having left the arms 37.

Once the cassette 11 which was used previously for printing is placed radially on the plate 54, the plate is rotated through 180° to bring the new cassette 11 opposite the openings of the uprights 1 and 2 and this new cassette 11 is introduced between the uprights, in the manner described hereinabove, then the connecting arm 51 is returned from its horizontal position to its vertical position, as shown in FIG. 4 in which its lower end is engaged in the notch 49.

Instead of using one rotating plate 54 provided in the upper part of the mobile carriage 53, several locations for accommodating cassettes might also be provided on this carriage, such locations being spaced apart from one another in the longitudinal direction. In this case, after having received a previously used cassette 11 in a determined location, it suffices to move the carriage longitudinally to bring the new cassette 11 opposite the openings made in the uprights 1 and 2.

What I claim is:

1. An offset printing machine with variable format comprising at least one inking roller receiving a layer of ink from an inking device and a layer of dampening solution from a dampening device, a plate cylinder tangential to the inking roller, a blanket cylinder tangential to the plate cylinder and an impression cylinder mounted on a mobile support so as to be applied under pressure against the blanket cylinder, the web to be printed passing between this blanket and the impression cylinder, the plate cylinder and the blanket cylinder being mounted to rotate between two vertical and longitudinal side elements connected together by cross pieces and forming therewith a cassette which is mobile transversely, i.e. perpendicularly to the direction of advance of the printed web, two upper transverse rails extending between two front and rear longitudinal uprights of the frame of the machine and from which the cassette is suspended, during a movement of introduction or removal of said cassette, via upper rollers of horizontal and longitudinal axes mounted in the upper part of the cassette, these two upper transverse rails projecting forwardly with respect to the front upright of the frame, this front upright bearing, on its outer face, two lower horizontal arms extending forwardly and on which the cassette rolls, during a movement of introduction or removal, via lower rollers of horizontal and longitudinal axes, mounted in the lower part of the cassette.

2. A machine according to claim 1, wherein the two lower horizontal arms borne by the front upright of the frame are mounted to pivot on this upright so as to be retracted along the front upright, in a substantially vertical position, when they are not used for the introduction or removal of a cassette.

3. A machine according to claim 1, wherein a drive pinion driven in rotation by a general control motor is mounted to rotate on the rear upright of the frame of the machine and this drive pinion is always in mesh, whatever the format of the print, with a pinion fast with the shaft of the blanket cylinder, said second pinion being in turn in mesh with a further pinion fast with the shaft of the plate cylinder mounted on the same cassette.

4. A machine according to claim 1, wherein the impression cylinder is mounted idly between two side elements constituting a mobile support mounted to pivot about a transverse axis and of which the position is adjusted by means of a jack disposed beneath the pivoting support and abutting on a base forming part of the frame of the machine.

5. A machine according to claim 1, wherein a first upper transverse rail is constituted by a portion of cylindrical bar presenting a horizontal upper flat portion on which may roll the upper rollers located above the rail, each of the vertical side elements of the cassette presents, in its vertical edge facing the first rail, a notch in the form of an arc of circle of which the radius corresponds to that of the cylindrical part of the first rail and made at a height, with respect to the lower edge of the side element, such that, when the cassette is introduced into the machine, this notch is substantially at the level of the first rail, the second transverse upper rail presents, in its upper face, a groove of triangular cross section and each upper roller disposed above the second rail is in biconical form, and each of the side elements of the cassette presents, in its vertical edge close to the second rail, a notch whose upper side, inclined with respect to the horizontal, constitutes a bearing surface for the end of the rod of a jack, each jack being mounted, on the associated upright of the frame, so as to be inclined and its axis is perpendicular to the bearing surface of the corresponding side element.

6. A machine according to claim 1, wherein each of the side elements of the cassette is in abutment, by its horizontal upper edge, against an adjustable stop whose position may be adjusted by means of a rod whose threaded end part is screwed in a tapped hole made in the stop.

7. A machine according to claim 6, wherein at least one of the side elements of the cassette presents, in its horizontal upper edge, a horizontal V-sectioned groove in which engages the lower part, also of V section, of the adjustable stop, the axis of the adjusting rod is slightly inclined with respect to the horizontal and the lower edge of the stop is in turn inclined by the same angle with respect to the axis of the rod so that this edge extends horizontally.

8. A machine according to claim 1, comprising in its lower part, beneath the impression cylinder, a transversely mobile support adapted to be pulled forwardly so as to be in overhang with respect to the front upright of the machine, and means fast with the front end of the mobile support to support the front vertical and longitudinal side element of the cassette, when the latter is pulled completely out of the machine.

9. A machine according to claim 8, wherein the mobile support comprises a horizontal platen of which the edges pass between guide rollers and at the front end of which is fixed a vertical bracket which presents a notch, in its upper face, and there may engage in the notch the end part of a connecting arm which is articulated about a horizontal pivot of transverse axis mounted in the median lower part of the front vertical side element of the cassette, which makes it possible to remove the cassette completely and support it in removed position on the mobile support, without other outside means.

* * * * *